US011143374B2

(12) United States Patent
Nykerk

(10) Patent No.: US 11,143,374 B2
(45) Date of Patent: Oct. 12, 2021

(54) LIGHT MODULE

(71) Applicant: Flex-N-Gate Advanced Product Development, LLC, Tecumeseh (CA)

(72) Inventor: Todd Nykerk, Holland, MI (US)

(73) Assignee: Flex-N-Gate Advanced Product Development, LLC, Tecumseh (CA)

( * ) Notice: Subject to any disclaimer, the term of this patent is extended or adjusted under 35 U.S.C. 154(b) by 0 days.

(21) Appl. No.: 16/598,403

(22) Filed: Oct. 10, 2019

(65) Prior Publication Data

US 2020/0116323 A1 Apr. 16, 2020

Related U.S. Application Data

(60) Provisional application No. 62/744,211, filed on Oct. 11, 2018.

(51) Int. Cl.

| | |
|---|---|
| ***F21S 41/24*** | (2018.01) |
| ***F21S 41/20*** | (2018.01) |
| ***F21S 41/151*** | (2018.01) |
| ***F21S 41/143*** | (2018.01) |

(52) U.S. Cl.

CPC ..... *F21S 41/24* (2018.01); *F21S 41/143* (2018.01); *F21S 41/151* (2018.01); *F21S 41/285* (2018.01)

(58) Field of Classification Search

CPC ..... F21S 41/143; F21S 41/33; F21S 41/36; F21S 41/331; F21S 41/24; F21S 41/663; F21S 41/151; F21S 41/153; B60Q 1/08

See application file for complete search history.

(56) References Cited

U.S. PATENT DOCUMENTS

| | | | | |
|---|---|---|---|---|
| 4,733,335 | A * | 3/1988 | Serizawa | B60Q 1/56 362/503 |
| 5,143,445 | A | 9/1992 | Bateman et al. | |
| 7,073,931 | B2 * | 7/2006 | Ishida | F21S 41/43 362/539 |
| 9,618,174 | B2 * | 4/2017 | Jungwirth | F21S 41/143 |
| 10,443,790 | B2 | 10/2019 | George et al. | |
| 10,627,065 | B2 * | 4/2020 | Godderidge | F21V 5/048 |
| 2008/0013333 | A1 * | 1/2008 | Koizumi | B60Q 1/2696 362/511 |
| 2014/0204602 | A1 * | 7/2014 | Jungwirth | F21S 41/24 362/521 |
| 2015/0192264 | A1 * | 7/2015 | Holzl | F21S 41/663 362/511 |

(Continued)

FOREIGN PATENT DOCUMENTS

| | | | |
|---|---|---|---|
| AT | 513738 | A1 | 7/2014 |
| DE | 102008013603 | A1 | 9/2009 |

(Continued)

OTHER PUBLICATIONS

PCT Patent Application PCT/US2019/055582 International Search Report and Written Opinion dated Jan. 15, 2020.

(Continued)

*Primary Examiner* — Matthew J. Peerce
(74) *Attorney, Agent, or Firm* — Erise IP, P.A.

(57) ABSTRACT

Disclosed is a vehicle lighting module. The module uses material that is configured into conical reflectors which are defined into the body. The reflectors include light guides which, along with the reflectors direct illumination from aligned LEDs into a condenser lens.

20 Claims, 3 Drawing Sheets

(56) References Cited

U.S. PATENT DOCUMENTS

| | | | | |
|---|---|---|---|---|
| 2015/0226395 | A1* | 8/2015 | Taudt | F21S 41/265 362/511 |
| 2015/0377453 | A1 | 12/2015 | Ji et al. | |
| 2016/0288699 | A1 | 10/2016 | Solar et al. | |
| 2017/0211770 | A1* | 7/2017 | Schmidt | F21S 41/285 |
| 2017/0314759 | A1 | 11/2017 | Nykerk et al. | |
| 2018/0252403 | A1 | 9/2018 | Hamid et al. | |
| 2018/0274745 | A1 | 9/2018 | Nykerk et al. | |
| 2019/0309924 | A1 | 10/2019 | Nykerk et al. | |
| 2019/0338930 | A1* | 11/2019 | Spinger | G02B 7/028 |

FOREIGN PATENT DOCUMENTS

| | | | |
|---|---|---|---|
| DE | 102009053581 | B3 | 3/2011 |
| DE | 102012204605 | A1 | 9/2013 |
| DE | 102017129254 | A1 | 7/2018 |
| EP | 0167092 | A2 | 6/1985 |
| EP | 2306074 | A2 | 4/2011 |
| EP | 3339720 | A1 | 6/2018 |
| JP | 2011249080 | A | 12/2011 |
| WO | 2014012128 | A1 | 1/2014 |

OTHER PUBLICATIONS

PCT Patent Application PCT/US2019/049703 International Search Report and Written Opinion dated Mar. 5, 2020.
European Patent Application 19871611.0 Supplemental European Search Report dated Jul. 13, 2021.

* cited by examiner

LIGHT MODULE

CROSS-REFERENCE TO RELATED APPLICATIONS

This application claims the benefit of U.S. Provisional Patent Application No. 62/744,211 filed Oct. 11, 2018, the contents of which are herein incorporated by reference.

BACKGROUND

1. Field of the Disclosure

Embodiments of this disclosure relate generally to the field of illumination systems and methods. More specifically, embodiments of this disclosure relate to the optics used to light emitted by plural light sources for vehicles.

2. Description of the Related Art

Vehicle headlamps come in numerous different configurations. It is known to use LEDs as the or one of a plurality of light sources on the vehicle. Further, numerous sorts of reflector, lens, and other light modifying arrangements are known in the industry.

SUMMARY

Disclosed is a vehicle headlight module. In embodiments, the module includes a plurality of LEDs mounted on a substrate. Each LED is coupled with one of a plurality of light guides having a light entry. The light entries for each light guide are oriented to receive light emitted from a particular LED. The module includes a body that is comprised of a reflective material. Each reflector substantially includes a light guide. An outer lens is adapted to receive light from the plurality of light guides and project the light out of the headlamp.

In embodiments, some of the LEDs can be dimmed to avoid glare to a selected location. In other embodiments, a control system is electronically connected with the LEDs, and can selectively illuminate at least some LEDs in the plurality, and deactivate others. The reflector body substantially prevents bleeding of light to the deactivated LED/reflector/light guide system.

In embodiments, the body is formed of silicone, optionally reflective white silicone. In yet further embodiments, the light guides are formed of transparent silicone. The body can, in embodiments, be a substantially-solid mass. Portions of the body of reflective material can form conical passageways, each having an outwardly tapering cross section moving from a location at the light entry towards the outer lens. Each of the of light guides can have an exterior surface which is included inside and conforms to an interior shape of the conical passageway defined inside the body of reflective material.

The LEDs can be arranged in a substantially linear array, and the light emitted from at least a first of the LEDs can be modified by a first light guide and a first discrete reflector arrangement defined by the body to create a light pattern which is different from a plurality of light patterns created by the other LEDs.

A lens arrangement is also disclosed. The lens can be configured to receive an illumination pattern received from the plurality of LEDs, and project into a more collimated pattern. In embodiments, the lens is a condenser lens. In further embodiments, the lens is extended in the direction of the aligned plurality of LEDs.

In other embodiments, the module includes a first light-emitting diode (LED) oriented to emit in a first direction; a second LED oriented to emit in a second direction; first and second reflectors defined into a body; the first reflector oriented to modify light received from the first LED, and the second reflector oriented to modify light received from the second LED; first and second light guides included in the first and second reflectors, respectively; and the first light guide configured to receive and direct light from the first LED and the second light guide configured to receive and direct light from the second LED.

This embodiment might include a control system electronically connected with the first and second LEDs, the control system configured to selectively illuminate either or both of the first and second LEDs. It also might be arranged where the first and second reflectors are formed into a body of reflective material. The first and second light guides might be formed from a transparent material. Also, the first and second reflectors might be made of white silicone, and the first and second light guides be made of transparent silicone.

Additionally, this version might also include a lens. More specifically, a condenser lens can be oriented to receive light exiting the first and second light guides. The lens may extend in the direction in which the first and second LEDs are aligned.

BRIEF DESCRIPTION OF THE DRAWINGS

Illustrative embodiments of the present disclosure are described in detail below with reference to the attached drawing figures, which are incorporated by reference herein and wherein.

DETAILED DESCRIPTION

Embodiments of the present disclosure include a module for a headlamp.

Figure 1:
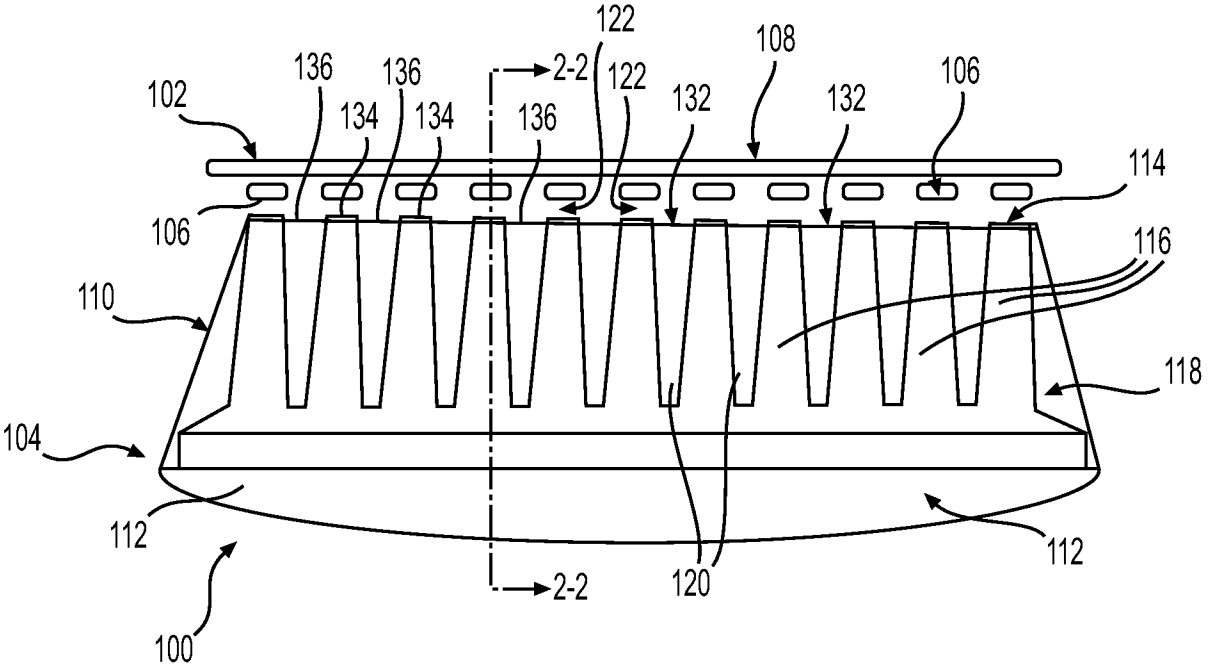
FIG. 1 is a top view of a light assembly, in an embodiment.
Figure 2:
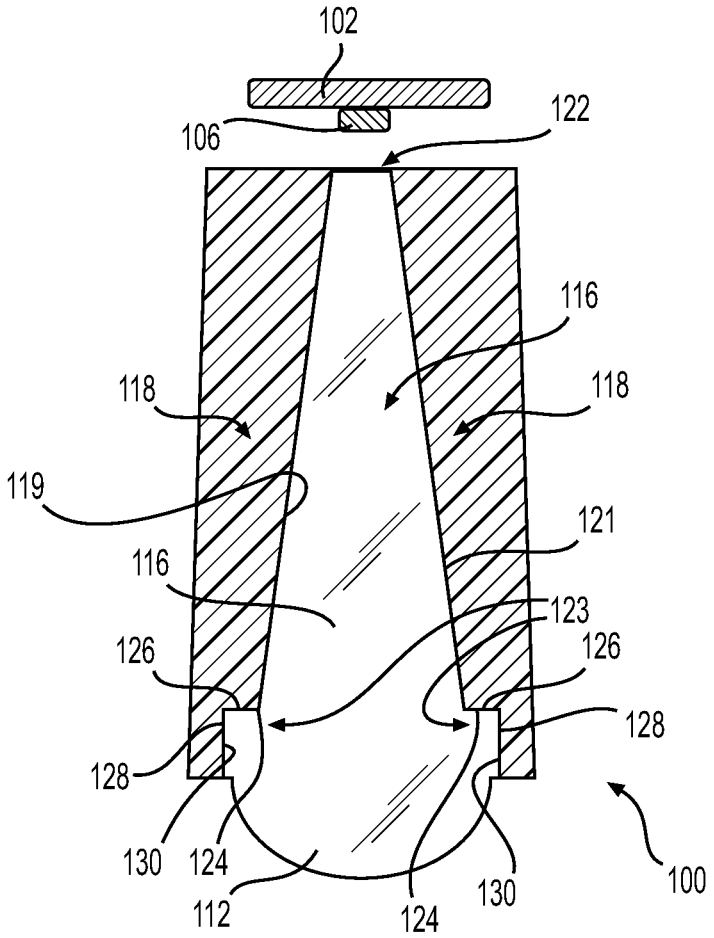
FIG. 2 is a cross-sectional side view of the module, in an embodiment.
Figure 3:
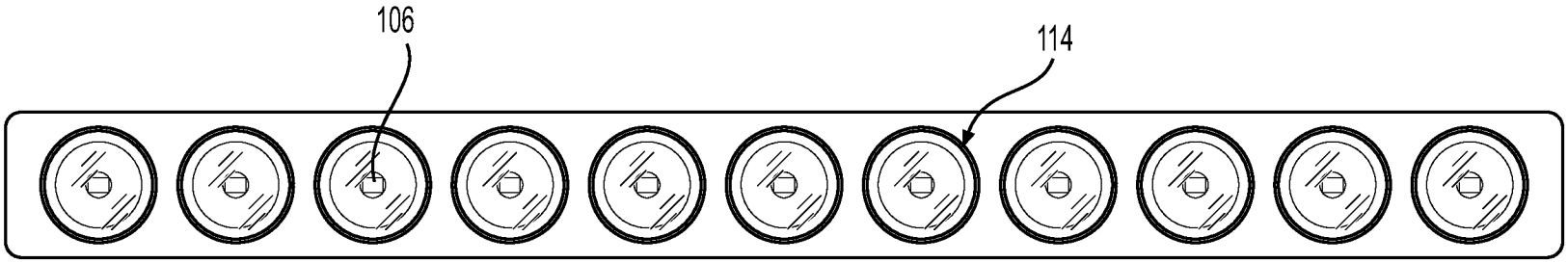
FIG. 3 is front view of the module.

Disclosed is a module 100. FIGS. 1-3 show an embodiment of the module 100, which is, in embodiments, a lighting system for a headlamp for a vehicle. Module 100, shown in the figures, includes additional components not depicted in FIG. 1 for clarity of illustration. Referring to FIG. 1, the module has light emission and light modifying components 102 and 104. Light emission equipment 102 includes a plurality of light-emitting diodes (LEDs) 106 mounted on a printed circuit board (PCB) 108. The LEDs 106 may be used as light sources for the headlamp 100, either exclusively or in combination with other types of lamps. In embodiments, LEDs 106 are individually addressable. Although the embodiment in FIGS. 1-3 shows a linear array of eleven laterally-spaced-apart LEDs 106 on the PCB 108, in other embodiments the LEDs can be arranged in another kind of array, a matrix, or a single LED could be subjected to the principles herein. In embodiments, the light emission arrangement 102 is configured for enabling selective illumination of the discrete LEDs in the array for the purpose of creating different light patterns.

The PCB 108 includes or is connected to electronics designed to control the LEDs. The electronic controls may include a headlamp control module having one or more of a computer, a microcontroller, a microprocessor, or a programmable logic controller (PLC) located onboard the vehicle and communicatively coupled with the LED matrices via the one or more printed circuit boards. The controller includes a memory, including a non-transitory medium for storing software, and a processor for executing instructions of the software. The memory may be used to store information used by the controller, including but not limited to algorithms, lookup tables, and computational models. The controller may include one or more switches (e.g., for performing pulse-width modulation). Communication between the controller and the LED/PCB may be by one of a wired and/or wireless communication media.

In embodiments, the individual LEDs in plurality 106 are each individually addressable. This enables only certain LEDs to be illuminated if desired in order to create a particular light pattern. For example, substantially all of the LEDs 106 might be illuminated if the desired pattern is intended as a high-beam for the headlight. Alternatively, in the event a low-beam pattern is desired, one or more LEDs in plurality 106 might not be activated to aid in creating the desired pattern. Still further, the selective illumination of particular LEDs might be only one factor in creating a desired pattern using reflection, or one or more lens arrangements. For a high-beam pattern, one or more LEDs in the plurality 106, once fully emitted, might be intended for a location at which it is desired to darken based on a dynamic consideration. For example, systems on the vehicle might detect an oncoming vehicle approaching in a particular segment. By selectively turning off one or more LEDs in plurality 106 which would ordinarily be projecting into that segment, glare caused to the oncoming driver may be eliminated.

In conventional LED lighting arrangements, there is a problem with respect to too much light reflecting on to one LED in the arrangement from other LEDs, e.g., caused by the reflection off of neighboring reflective surfaces. This, in the process of activating select LEDs and leaving some others inactive, light spill-over would make it impossible to completely prevent illumination through one reflector arrangement. This could result in excess glare to an oncoming driver. For example, the deactivated group of LEDs might have been turned off to avoid shining in the eyes of a detected oncoming driver. Upon this occurrence, any illumination leaking into that LEDs reflector/lens arrangement would glare into the oncoming traffic.

The disclosed module avoids this using the fully divided module 100. The light modifying component 104 of the module 100 is divided into a light-guiding section 110, and a lens 112 from which light exits. In embodiments, the lens 112 is a condenser lens that is used to take the diverging pattern and project it in a more collimated pattern. As can be seen, the condenser lens 112 is extended in the direction of the aligned plurality of LEDs 106. The individually-addressable LEDs 106 emit into corresponding LED light-entry points 114. A space is created between the LEDs 106 and each entry point 114, in an embodiment, by containing each in a housing (not shown). The coupling together of the PCB 108 to the modifying component 104 is done so that each LED 106 lines up with a respective light-entry point 114.

The space created between the LEDs 106 and the entry points 114 is manifested as a gap 122. After crossing the gap 122, the light received into each of the points 114 travels through each of a plurality of substantially transparent silicone light guides 116. All outer surfaces of the silicone light guides 116 are contained in a reciprocally-shaped reflective white silicone body 118. The result is that white reflective silicone body 118 creates internal as well as other reflection which redirects the light in a desired pattern out of the guide in the direction of the lens 112. The immersion of the light guides 116 into the white reflective body 118 results in reflective dividing ridges 120 of white reflective silicone (when the device is viewed in the top view of the section of FIG. 1).

From FIG. 2 it can be seen that the light guides are comprised of outwardly tapering/conical outer surfaces 121 up to the point they reach lens 112. The cross-section of FIG. 2 is taken from the line indicated as 2-2 in FIG. 1. The opposed conical inner wall surfaces 119 of the white silicone body contain the light, and will prevent light bleed upon ultimate transmission out of the module. Also in FIG. 3, one can see that the ridges 120 from FIG. 2 appear as spaces between each light guide in FIG. 3. Although not necessarily clear from FIG. 3, it should be understood that in many embodiments the circular outputs into the lens 120 from the light guides 116 would be offset to an extent to provide more spread, or to meet some other optical directional objective.

Also seen in FIG. 2 is that the conical tapered wall 121 of each light guide in plurality 114 extends toward the lens, and then at a head 123 of each guide 116, a shelf 124 is formed, on which underside ledge 126 of each light guide 116 abuts. Also at head 123, an outside cylindrical surface 128 of light guide 116 is configured to be received into an interior cylindrical surface 130 formed in the reflective white silicone body 118, and then abuts surface 128 on the head 123 of each light guide 116.

Although the conical reflectors, in the disclosed embodiment, are defined into a substantially solid silicone body, those skilled in the art will recognize that a different arrangement where silicone or other reflective materials are deposited on less solid or hollow reflector forms could be used instead and still fall within the scope of the broad concepts disclosed herein.

It should also be noted that, although the figures show all of the LED/reflector/light guide arrangements defined in the module 100 as being substantially the same, that is not necessarily or even ideally the case. Thus, it should be understood that in embodiments, as discussed already, the individual LEDs in plurality 106 are in many instances individually addressable to create different lighting patterns due to the LEDs in array 106 which are selected to create the desired light pattern. Therefore, (i) the LEDs each might be spaced differently behind each light entry point; (ii) each reflector defined within the body might have a different configuration or direction to aim light differently and therefore differently contribute to an overall pattern; and (iii) the light guides may have different configurations within the body to create various effects. This might involve diversity in the central axis for different light guides, as well as deviations from the conical shapes shown, as well as lens spacing and lens configurations.

For example, in order for the same lamp to make the typical high and low beam patterns possible, some of the LEDs will have to throw light down and outside to meet the requirements of a low beam pattern. Similarly, other LEDs will have to direct light generally head on to meet the high-beam requirements. Thus, optical diversity between each LED/light guide/reflector system is contemplated herein and is an aspect of what is disclosed.

This diversity in the optics serving each LED is also useful in deactivating certain LEDs to avoid glare upon a vehicle location in an automatic dimming arrangement. Thus, a headlamp according to the general principles expressed regarding the embodiments disclosed in FIGS. 1-3 will contemplate differently directed optics depending on the application.

In embodiments, the overall shape of the PCB 108 is substantially or completely rectangular, and substantially matches the shape of a rear wall 132 of the light modifier system 104. More generally, the module is formed as some sort of "block." The term "block" as used herein, is not intended to imply any particular shape other than that is a mass of some uniformity (e.g., could have rounding, be somewhat elliptical, etc.) Thus, the term should not be narrowly construed.

The rear wall 132 comprises the entry point walls 134 and back portion 136 of the body 118, which exist, in embodiments, in substantially the same plane, or are slightly offset in parallel planes. Because the back portion 136 of the body 118 and the shape of the PCB 108 are substantially the same, prefabricated LED positions can be easily mated with the light-entry points 114 so that the two are optically in line. This makes the device easier to manufacture. Although not shown, it is possible that spacing devices of some sort exist between the forward surface of the PCB 108 and the rear wall 132 of the body 118 (or are incorporated into the housing) in order to create uniform spacing of a given dimension, ensuring that the front of the PCB 108 and the rear body surface 132 are opposed and parallel.

Collectively, the light source and light modifier systems 102 and 104 project a beam pattern in front of a vehicle. This pattern could include a high-beam pattern, a low beam pattern, or any other pattern. And based on the selective illumination of the LEDs 106, the pattern may be a reaction to a detected status, e.g., the presence and location of an on-coming vehicle.

The overall configuration causes the light to propagate through each distinctive light guide portion to the exit optics. The containment of the light prior to entering the lens prevents light bleed. Further, the block-like shape of the overall device makes the matching up of parts (e.g., PCB to light guide module to lens) easy to achieve, and additionally, the silicone body configuration facilitates easy locating and attachment and reattachment into a vehicle housing.

Features described above as well as those claimed below may be combined in various ways without departing from the scope hereof. The following examples illustrate some possible, non-limiting combinations:

(A1) A vehicle headlamp includes a plurality of light-emitting diodes (LEDs) mounted on a substrate, and a plurality of light guides each having a light entry, each light entry being oriented to receive light emitted from a particular LED in the plurality. A body includes a reflective material, and the body substantially includes the plurality of light guides inside of a plurality of discretely defined reflector arrangements. An outer lens is adapted to receive light from the plurality of light guides and project the light out of the headlamp.

(A2) For the vehicle headlamp denoted as (A1), the at least some LEDs in the plurality are dimmed to avoid glare to a selected location.

(A3) For the vehicle headlamp denoted as either (A1) or (A2), the headlamp includes a control system electronically connected with the plurality of LEDs. The control system is configured to selectively illuminate at least some LEDs in the plurality, and deactivate at least one other LED. The body substantially prevents lateral bleeding of light to the deactivated LED.

(A4) For the vehicle headlamp denoted as any of (A1) through (A3), the body is formed of silicone.

(A5) For the vehicle headlamp denoted as any of (A1) through (A4), the body is formed of reflective white silicone.

(A6) For the vehicle headlamp denoted as any of (A1) through (A5), the light guides are formed of transparent silicone.

(A7) For the vehicle headlamp denoted as any of (A1) through (A6), the body of reflective material is formed of reflective silicone, and the light guides are formed within the body of reflected material to form a common substantially-solid mass.

(A8) For the vehicle headlamp denoted as any of (A1) through (A7), a plurality of portions of the body of reflective material each form a conical passageway having an outwardly tapering cross section moving from a location at the light entry towards the outer lens.

(A9) For the vehicle headlamp denoted as any of (A1) through (A8), each of the of light guides has an exterior surface which is included inside and conforms to an interior shape of the conical passageway defined inside the body of reflective material for each of the plurality of portions.

(A10) For the vehicle headlamp denoted as any of (A1) through (A9), the plurality of LEDs are arranged in a substantially linear array.

(A11) For the vehicle headlamp denoted as any of (A1) through (A10), the light emitted from at least a first of the plurality of light-emitting diodes (LEDs) mounted on a substrate is modified by a first light guide and a first discrete reflector arrangement defined by the body to create a light pattern which is different from a plurality of light patterns created by the other LEDs in the plurality.

(A12) For the vehicle headlamp denoted as any of (A1) through (A11), the lens is configured to receive an illumination pattern received from the plurality of LEDs, and project into a more collimated pattern.

(A13) For the vehicle headlamp denoted as any of (A1) through (A12), the lens is a condenser lens.

(A14) For the vehicle headlamp denoted as any of (A1) through (A13), the lens is extended in the direction of the aligned plurality of LEDs.

(B1) An illumination device includes a first light-emitting diode (LED) oriented to emit light in a first direction, a second LED oriented to emit light in a second direction, and first and second reflectors defined into a body. The first reflector is oriented to modify light received from the first LED, and the second reflector is oriented to modify light received from the second LED. First and second light guides are included in the first and second reflectors, respectively. And, the first light guide is configured to receive and direct light from the first LED and the second light guide is configured to receive and direct light from the second LED.

(B2) For the illumination device denoted as (B1), a control system is electronically connected with the first and second LEDs. The control system is configured to selectively illuminate either or both of the first and second LEDs.

(B3) For the illumination device denoted as either (B1) or (B2), the first and second reflectors are formed into a body of reflective material.

(B4) For the illumination device denoted as any of (B1) through (B3), the first and second light guides are formed from a transparent material.

(B5) For the illumination device denoted as any of (B1) through (B4), the first and second reflectors include white silicone, and the first and second light guides comprise transparent silicone.

(B6) For the illumination device denoted as any of (B1) through (B5), the headlamp includes a condenser lens oriented to receive light exiting the first and second light guides. The condenser lens extends in the direction in which the first and second LEDs are aligned.

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims. Not all operations listed in the various figures need be carried out in the specific order described.

The invention claimed is:

1. A vehicle headlamp, comprising:

a plurality of light-emitting diodes (LEDs) mounted on a substrate;

a plurality of light guides each formed of a transparent material into a conical shape, such that the conical shape has a narrow end opposite a wide end, the narrow end providing a light entry, each light entry being oriented to receive light emitted from a particular LED in the plurality;

a body comprised of a reflective white material, the body substantially including the plurality of light guides to form a common substantially-solid mass;

a plurality of discretely defined reflector arrangements formed within the body for reflecting light within each of the plurality of light guides, respectively; and an outer lens adapted to receive light from the plurality of light guides and project the light out of the headlamp.

2. The headlamp of claim 1 comprising:

a control system electronically connected with the plurality of LEDs, the control system configured to selectively illuminate at least some LEDs in the plurality, and deactivate at least one other LED, the body substantially preventing lateral bleeding of light from light guides oriented to receive light from illuminated LEDs to the at least one light guide oriented to receive light from the at least one other LED that is deactivated.

3. The headlamp of claim 2 wherein the at least some LEDs in the plurality are configured to be dimmed, under control of the control system, to avoid glare to a selected location.

4. The headlamp of claim 1 wherein the body is formed of reflective white silicone.

5. The headlamp of claim 1 wherein the light guides are formed of transparent silicone.

6. The headlamp of claim 1 wherein the plurality of discretely defined reflector arrangements formed within the body of white reflective material each have a circular cross section, with a smaller radius at the light entry and a larger radius towards the outer lens.

7. The headlamp of claim 1 wherein a plurality of portions of the body of reflective white material each form a conical passageway, and each of the of light guides has an exterior surface which is included inside and conforms to an interior shape of the conical passageway.

8. The headlamp of claim 1 wherein the plurality of LEDs are arranged in a substantially linear array.

9. The headlamp of claim 1 wherein the plurality of light guides comprises a first light guide having a first discrete reflector arrangement defined by the body that differs from other light guides in the plurality, wherein the first light guide has a wider conical shape such that a first light pattern is spread more broadly than other light patterns created by the other light guides in the plurality.

10. The headlamp of claim 1 wherein the lens is configured to receive an illumination pattern received from the plurality of LEDs, and project into a more collimated pattern.

11. The headlamp of claim 10 wherein the lens is a condenser lens.

12. The headlamp of claim 1 wherein the lens is extended in the direction of the aligned plurality of LEDs.

13. An illumination device comprising:

a first light-emitting diode (LED) oriented to emit light in a first direction;

a second LED oriented to emit light in a second direction;

a first reflector having a conical shape and a second reflector having a conical shape, the first and second reflectors each being defined into a body of reflective material;

the first reflector oriented to modify light received from the first LED, and the second reflector oriented to modify light received from the second LED;

a first light guide and a second light guide included in the first reflector and the second reflector, respectively, wherein the first and second light guides are formed into a conical shape from a transparent material; and the first light guide is configured to receive and direct light from the first LED and the second light guide configured to receive and direct light from the second LED, wherein the first and second light guides are formed within the body of reflective material to form a common substantially-solid mass.

14. The illumination device of claim 13 comprising:

a control system electronically connected with the first and second LEDs, the control system configured to selectively illuminate either or both of the first and second LEDs.

15. The illumination device of claim 13 wherein the first and second reflectors comprise white silicone, and the first and second light guides comprise transparent silicone.

16. The illumination device of claim 13 comprising:

a first condenser lens oriented to receive light exiting the first light guide and a second condenser lens oriented to receive light exiting the second light guides, wherein the first condenser lens and the second condenser lens each extend outside of the body of reflective material in the direction in which the first LED and second LED are aligned, respectively.

17. A vehicle headlamp, comprising:

a plurality of light-emitting diodes (LEDs) mounted on a substrate;

a plurality of light guides each formed of transparent material, wherein each of the plurality of light guides has a conical-shaped portion and a cylindrical-shaped portion, wherein the conical-shaped portion has a narrow end opposite a wide end, the narrow end providing a light entry oriented to receive light emitted from a particular one of the plurality of LEDs, and the wide end providing a light exit oriented to emit light into the cylindrical-shaped portion;

a body comprised of a reflective white material, the body having a plurality of openings configured to accept the plurality of light guides such that the body substantially prevents lateral bleeding of light between each of the plurality of light guides;

a plurality of outer lenses adapted to receive light from the plurality of light guides, respectively, and project the light out of the headlamp; and a control system electronically connected with the plurality of LEDs, the control system configured to individually control illumination of each of the plurality of LEDs for shaping a pattern of light emitted from the vehicle headlamp.

18. The vehicle headlamp of claim 17, wherein the cylindrical-shaped portion of each of the plurality of light guides is configured for connecting the respective conical-shaped portion of each of the plurality of light guides with the respective one of the plurality of outer lenses.

19. The vehicle headlamp of claim 18, wherein each cylindrical-shaped portion comprises a wider diameter than the wide end of each conical-shaped portion, such that each cylindrical-shaped portion forms a shelf, and each one of the plurality of openings of the body comprises a ledge configured to abut the shelf.

20. The vehicle headlamp of claim 18, wherein each of the plurality of outer lenses protrudes outside of the body.

* * * * *